US007955141B2

(12) United States Patent
Jang et al.

(10) Patent No.: US 7,955,141 B2
(45) Date of Patent: Jun. 7, 2011

(54) INVERTER CONNECTION TERMINAL WITH CABLES ATTACHED TO PARTS OF THE TERMINAL PROJECTING FROM UPPER AND LOWER SURFACES OF A PLATE

(75) Inventors: Se Hoon Jang, Suwon-si (KR); Young Chang Han, Jeonju-si (KR); In Hwe Koo, Seongnam-si (KR); Geon Ho Lee, Seongnam-si (KR)

(73) Assignees: Doowon Technical College, Anseing-shi (KR); Doowon Electronic Co., Ltd., Asan-shi (KR)

( * ) Notice: Subject to any disclaimer, the term of this patent is extended or adjusted under 35 U.S.C. 154(b) by 0 days.

(21) Appl. No.: 12/633,163

(22) Filed: Dec. 8, 2009

(65) Prior Publication Data

US 2010/0141066 A1 Jun. 10, 2010

(30) Foreign Application Priority Data

Dec. 9, 2008 (KR) ..... 10-2008-0124526

(51) Int. Cl.
*H01R 9/22* (2006.01)

(52) U.S. Cl. ..... 439/709

(58) Field of Classification Search ..... 439/709–721, 439/801, 808, 883, 620.28
See application file for complete search history.

(56) References Cited

U.S. PATENT DOCUMENTS

| | | | | |
|---|---|---|---|---|
| 5,203,724 | A * | 4/1993 | Casey | 439/792 |
| 5,674,098 | A * | 10/1997 | Inaba et al. | 439/883 |
| 6,902,434 | B2 * | 6/2005 | Stack | 439/620.28 |
| 6,916,213 | B2 * | 7/2005 | Nyblin et al. | 439/709 |
| 7,438,603 | B1 * | 10/2008 | Lewis | 439/709 |
| 2001/0024911 | A1 * | 9/2001 | Bre' et al. | 439/717 |

* cited by examiner

*Primary Examiner* — Chandrika Prasad
(74) *Attorney, Agent, or Firm* — Hamre, Schumann, Mueller & Larson, P.C.

(57) ABSTRACT

The present invention provides an inverter connection terminal assembly for an electric compressor. The inverter connection terminal assembly includes a connection terminal, in which upper and lower terminal projections project from the upper and lower surfaces of a plate, respectively, an inverter connection cable connected to the upper terminal projection of the connection terminal, a motor connection cable connected to the lower terminal projection of the connection terminal, an upper connector for connecting the upper terminal projection and the inverter connection cable, and a lower connector for connecting the lower terminal projection and the motor connection cable, wherein the lower terminal projection of the connection terminal includes a thread formed on the surface thereof such that the motor connection cable is fixed to the lower terminal projection by fastening a nut while a washer and a ring connector are sequentially inserted into the lower terminal projection.

1 Claim, 4 Drawing Sheets

INVERTER CONNECTION TERMINAL WITH CABLES ATTACHED TO PARTS OF THE TERMINAL PROJECTING FROM UPPER AND LOWER SURFACES OF A PLATE

CROSS-REFERENCE TO RELATED APPLICATION

This application claims priority to and the benefit of Korean Patent Application No. 10-2008-0124526, filed on Dec. 9, 2008, the disclosure of which is incorporated herein by reference in its entirety.

BACKGROUND

1. Field of the Invention

The present invention relates to an inverter connection terminal assembly and, more particularly, to an inverter connection terminal assembly for an electric compressor, in which a plurality of connectors are arranged in the horizontal direction of the inverter connection terminal assembly so as to reduce the external diameter of the compressor.

2. Discussion of Related Art

In general, a variety of compressors, such as a reciprocating compressor, a rotary compressor, a screw compressor, etc., are applied to refrigeration and air conditioning systems.

The reciprocating compressor sucks, compresses, and discharges a working fluid, i.e., refrigerant, while a piston reciprocates in a cylinder, and the rotary compressor compresses the refrigerant while a rotor rotates in a cylinder.

In the scroll compressor, the refrigerant is compressed in a pocket, whose volume varies, disposed between scroll wraps formed in a fixed scroll and an orbiting scroll, respectively, while the orbiting scroll orbits with respect to the fixed scroll.

Meanwhile, an electric compressor, which uses an electric motor as a power source, comprises a motor unit including a drive motor and a compressor unit for compressing the refrigerant.

Recently, an inverter for controlling the rotational speed of the drive motor is provided in the electric compressor to variably control the cooling efficiency of the refrigeration and air conditioning system when external load conditions are changed.

FIG. 1A is a schematic cross-sectional view showing an electric compressor in accordance with a prior art.

As shown in FIG. 1A, in the prior art electric compressor, a compressor unit (not shown) is provided on one side 11 of a compressor housing 10 and a driver motor (not shown) is provided on the other side 12.

Moreover, an inverter 20 is provided on the outer circumferential surface of the compressor housing 10 adjacent to the driver motor, specifically in an inverter housing 21 formed on the outer circumferential surface of the compressor housing 10.

Here, the inverter 20 variably controls the rotational speed of the drive motor to control the amount of refrigerant circulated through an air conditioner cycle and includes a printed circuit board (PCB) on which various circuit elements are mounted and other connecting wires. The bottom surface of the PCB is arranged to be in contact with the inner bottom surface of the inverter housing 21 by a compound having insulation and heat dissipation performance.

The circuit elements mounted on the PCB can be classified into low power elements consuming low power and high power elements consuming higher power.

The low power elements include an MCU having an IC in which an inverter operation program is stored, and other OP AMP circuits, and the high power elements include an insulated gate bipolar transistor (IGBT) for the operation of the drive motor, an intelligent power module (IPM) having a motor drive function, a high voltage regulator, an inductor, an input capacitor, etc.

Moreover, the inverter 20 is electrically connected to the drive motor through a motor-inverter connection terminal assembly (A) as shown in FIG. 1B.

The motor-inverter connection terminal assembly (A) includes a connection terminal 40, in which upper and lower terminal projections 46 and 44 project from the upper and lower surfaces of a plate 41, respectively, cables 43 and 45 connected to the connection terminal 40, and connectors for connecting the connection terminal 40 and the cables 43 and 45, respectively.

First, the inverter connection cable 43 extending from the inverter 20 is connected to the upper terminal projection 46, and the motor connection cable 45 extending from the motor is connected to the lower terminal projection 44.

Moreover, male connectors 46*a* and 44*a* are fixedly mounted on the upper and lower terminal projections 46 and 44, respectively, and female connectors 43*a* and 45*a* are installed on the cables 43 and 45 extending from the inverter 20 and the motor, respectively, such that the male connectors 46*a* and 44*a* are connected to the female connectors 43*a* and 45*a*.

The terminal projections 46 and 44 and the male connectors 46*a* and 44*a* may be fixed by welding or the like.

However, in the above-described prior art electric compressor, the lower terminal projection 44 and the motor connection cable 45 are connected in a straight line in terms of the characteristics of the connectors, which requires a large space in the vertical direction, thus increasing the external diameter of the compressor.

Moreover, during the operation of the compressor, the cables 43 and 45 may be disconnected from the connection terminal 40 due to vibration, thus cutting off the power supply.

SUMMARY OF THE INVENTION

The prevent invention has been made in an effort to solve the above-described problems associated with the prior art, and an object of the present invention is to provide an inverter connection terminal assembly for an electric compressor, which can reduce the external diameter of the compressor by changing the assembling direction of a lower terminal projection and a lower connector extending from a motor and prevent a motor connection cable from being disconnected from a connection terminal due to vibration by configuring the lower connector as a ring connector and fixing the lower connector to the connection terminal by means of a nut, thus allowing the compressor to stably operate.

According to an aspect of the present invention for achieving the above objects, there is provided an inverter connection terminal assembly for an electric compressor, the inverter connection terminal assembly including: a connection terminal, in which upper and lower terminal projections project from the upper and lower surfaces of a plate, respectively; an inverter connection cable connected to the upper terminal projection of the connection terminal; a motor connection cable connected to the lower terminal projection of the connection terminal; an upper connector for connecting the upper terminal projection and the inverter connection cable; and a lower connector for connecting the lower terminal projection and the motor connection cable, wherein the lower terminal projection of the connection terminal includes a thread formed on the surface thereof such that a washer and a ring connector to which the motor connection cable is fixed are sequentially inserted into the lower terminal projection and then the lower terminal projection is fastened by a nut.

Preferably, the upper terminal projection of the connection terminal may include a thread formed on the surface thereof such that a washer and a ring connector to which the inverter connection cable is fixed are sequentially inserted into the upper terminal projection and then the upper terminal projection is fastened by a nut.

Preferably, an insulating member may be interposed between the washer and the plate.

Preferably, the ring connector and the cable may be fixed by a cable connection unit formed of a ring-shaped metal plate.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Hereinafter, exemplary embodiments of the present invention will be described in detail below with reference to the accompanying drawings such that those skilled in the art to which the present invention pertains can easily practice the present invention.

In an electric compressor according to the present invention, other elements than an inverter-motor connection terminal assembly and cables are well known in the art, and thus their detailed description will be omitted.

Figure 1A:
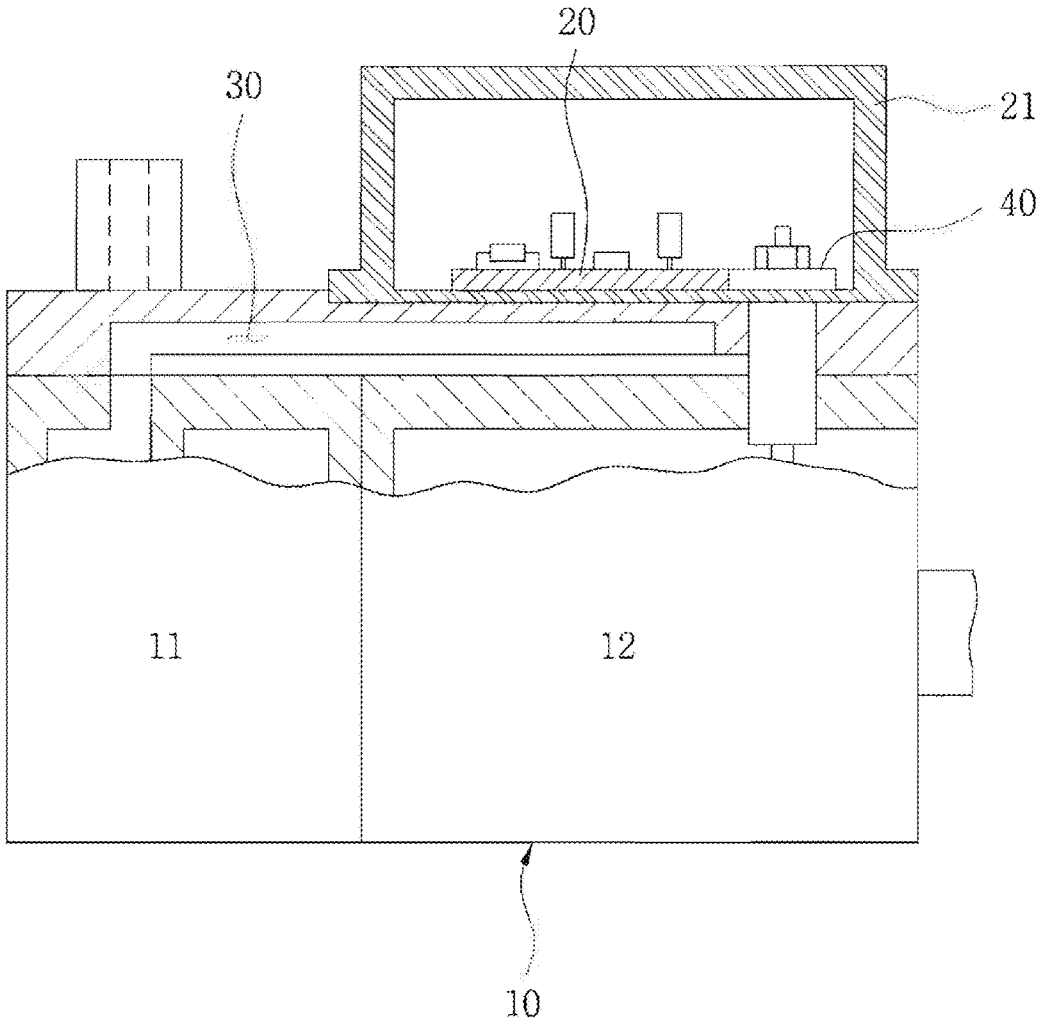
FIG. 1A PRIOR ART
FIG. 1A is a cross-sectional view showing the peripheral configuration of an inverter of a typical electric compressor.
Figure 1B:
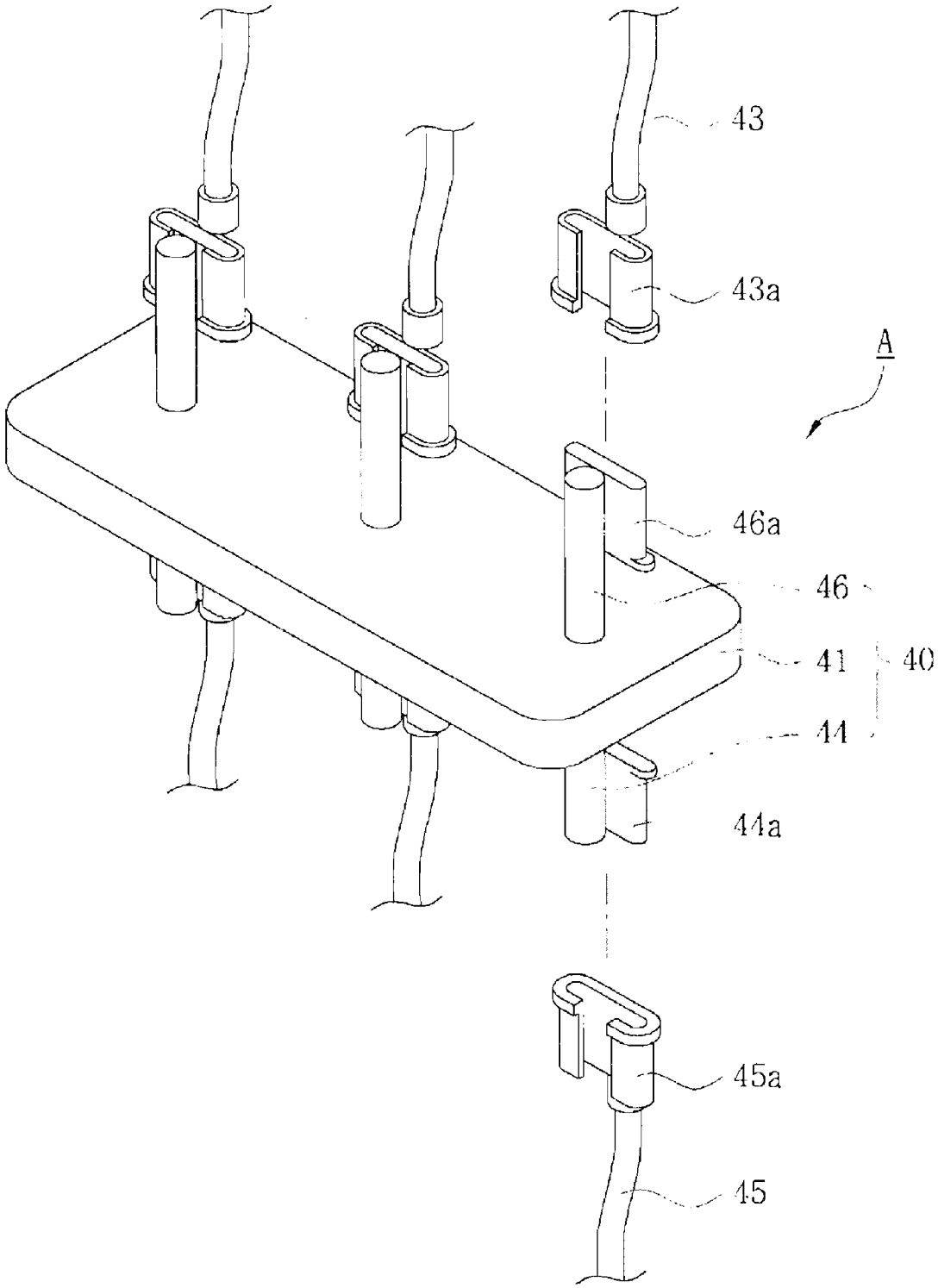
FIG. 1B PRIOR ART
FIG. 1B is a partial exploded perspective view showing a connection terminal assembly in accordance with a prior art.
Figure 2:
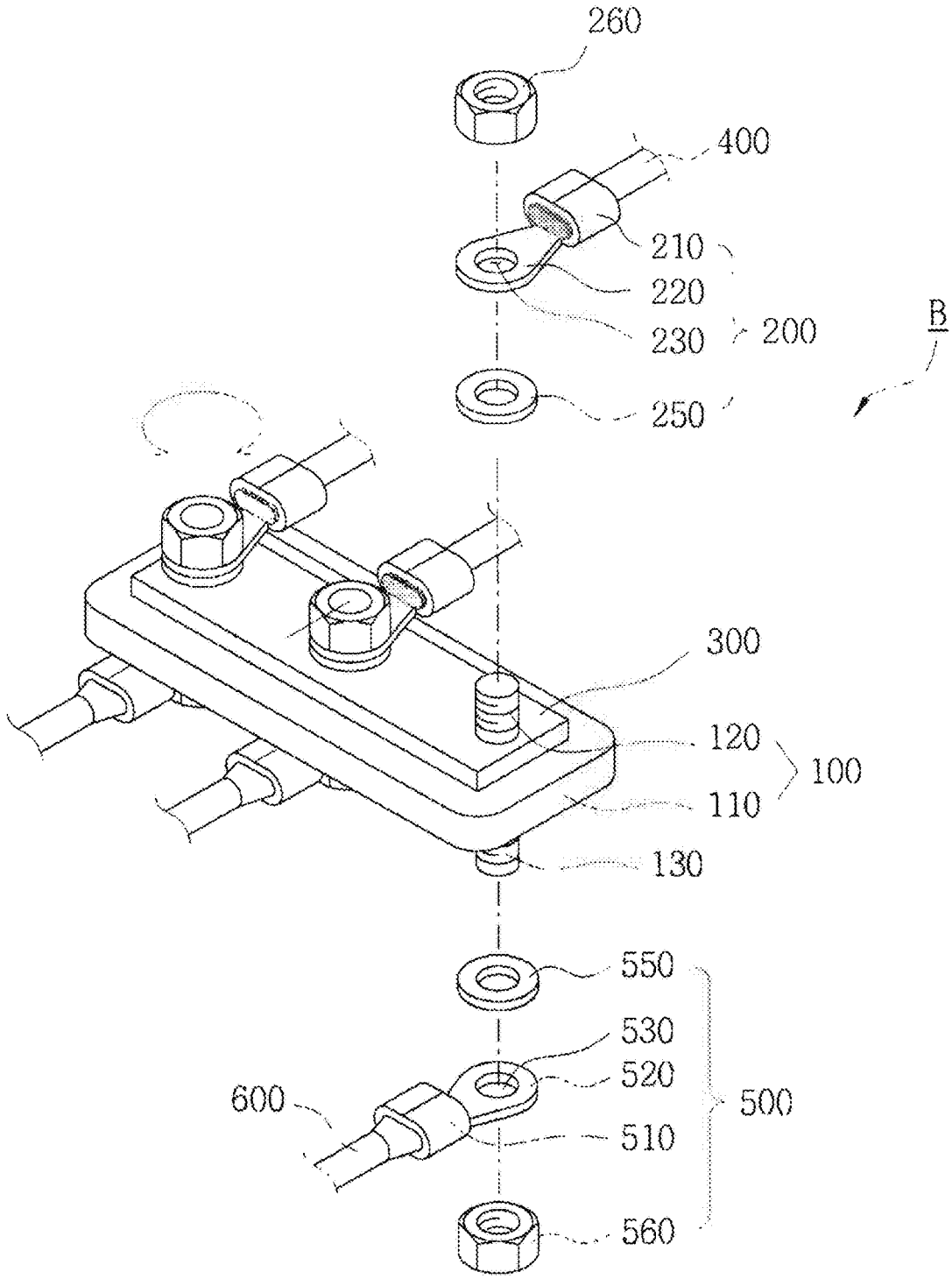
FIG. 2 is a partial exploded perspective view showing a connection terminal assembly in accordance with the present invention.

As shown in FIG. 2, an inverter-motor connection terminal assembly (B) in accordance with the present invention may include a connection terminal 100, in which upper and lower terminal projections 120 and 130 project from the upper and lower surfaces of a plate 110, respectively, cables 400 and 600 connected to the connection terminal 100, and upper and lower connectors 200 and 500 for connecting the connection terminal 100 and the cables 400 and 600, respectively.

In detail, the inverter connection cable 400 is connected to the upper terminal projection 120 of the connection terminal 100 via the upper connector 200, and the motor connection cable 600 is connected to the lower terminal projection 130 of the connection terminal 100 via the lower connector 500.

Especially, a thread is formed on the surface of the lower terminal projection 130 of the connection terminal 100 such that a washer 550 and a ring connector 520 to which the motor connection cable 600 is fixed are sequentially inserted into the lower terminal projection 130 and then the lower terminal projection 130 is fastened by a nut 560.

Since the end of the motor connection cable 600 is fixed to the ring connector 520 having an insertion hole 530, the motor connection cable 600 can be arranged in the horizontal direction.

Figure 3:
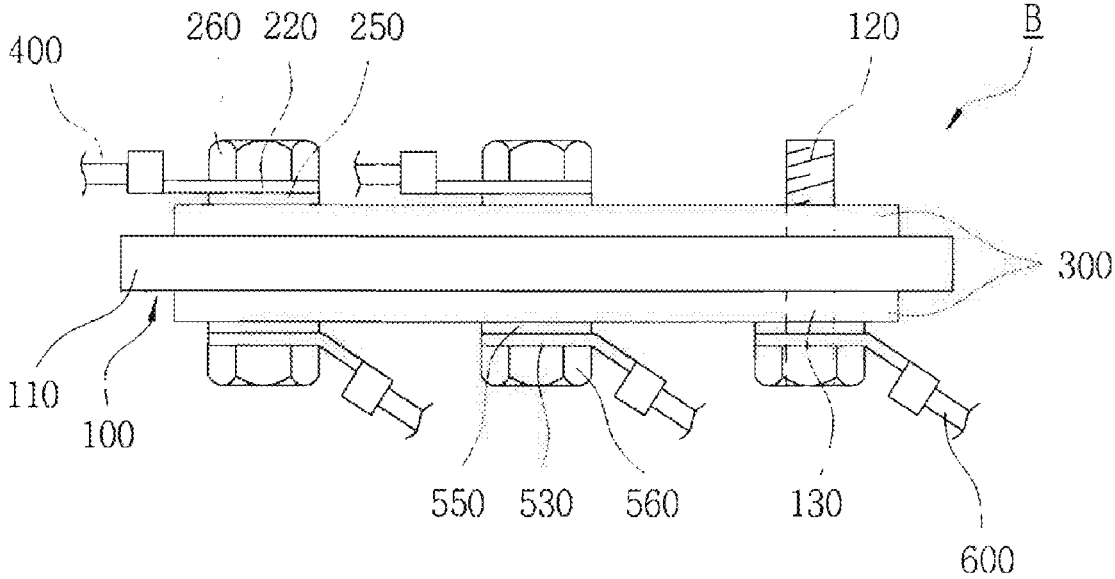
FIG. 3 is a side cross-sectional view showing the connection terminal assembly in accordance with the present invention.

As shown in FIGS. 2 and 3, the upper terminal projection 120 of the connection terminal 100 and the upper connector 200 for connecting the inverter connection cable 400 may have the same structure as the lower connector 500.

That is, the upper connector 200 includes a ring connector 220, an insertion hole 230, a washer 250, and a nut 260.

Moreover, an insulating member 300 is assembled between the connection terminal 100 and the upper and lower connectors 200 and 500, respectively. A hole is formed in the insulating member 300 in a position corresponding to the upper and lower terminal projections 120 and 130 such that the upper and lower terminal projections 120 and 130 are inserted therethrough.

The insulating member 300 serves to prevent a short circuit from occurring when adjacent conductors are in contact therewith during the assembly.

The ring connectors 220 and 520 may be fixed to the cables 400 and 600 by means of cable connection units 210 and 510. In FIG. 2, the cable connection units 210 and 510 are formed of a ring-shaped metal plate such that the cables 400 and 600 are inserted and fixed thereto. However, any structures known in the art to which the cables are connected may be used as the cable connection units 210 and 510.

Moreover, as shown with the arrows in FIG. 2, it is possible to freely change the rotation direction of the cables 400 and 600 through the ring connectors 220 and 520 assembled in the above-described manner, and thereby it is easy to ensure sufficient space in the compressor, the assembly is facilitated, and it is possible to avoid interference with adjacent elements.

As described above, according to the inverter terminal connection assembly for the electric compressor of the present invention, it is possible to assemble the lower terminal projection with the female connector extending from the motor in the horizontal direction, and thereby it is possible to eliminate the unnecessary space in the vertical direction, thus reducing the external diameter of the compressor.

Moreover, according to the present invention, the lower terminal projection having a thread is inserted into the female connector extending from the motor and fixed by means of a nut, and thereby it is possible to prevent the connector from being disconnected from the connection terminal due to vibration.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. An inverter connection terminal assembly for an electric compressor, the inverter connection terminal assembly comprising:

a connection terminal, in which upper and lower terminal projections project from the upper and lower surfaces of a plate, respectively;

an inverter connection cable connected to the upper terminal projection of the connection terminal;

a motor connection cable connected to the lower terminal projection of the connection terminal;

an upper connector for connecting the upper terminal projection and the inverter connection cable, the upper connector including a first washer, a first ring connector fixed to the inverter connection cable, and a first nut, wherein the upper terminal projection of the connection terminal comprises a thread formed on the surface thereof such that the first washer and the first ring connector are sequentially inserted into the upper terminal projection and then the upper terminal projection is fastened by the first nut;

a lower connector for connecting the lower terminal projection and the motor connection cable, the lower connector including a second washer, a second ring connector fixed to the motor connection cable, and a second nut, wherein the lower terminal projection of the connection terminal comprises a thread formed on the surface thereof such that the second washer and the second ring connector are sequentially inserted into the lower terminal projection and then the lower terminal projection is fastened by the second nut, wherein the first ring connector and the inverter connection cable being fixed by a first cable connection unit formed of a first ring-shaped metal plate, wherein the second ring connector and the motor cable being fixed by a second cable connection unit formed of a second ring-shaped metal plate;

an upper insulating member interposed between the first washer and the plate; and a lower insulating member interposed between the second washer and the plate.

* * * * *